United States Patent [19]

Kito et al.

[11] Patent Number: 4,782,667

[45] Date of Patent: Nov. 8, 1988

[54] ICE DISCHARGE SECTION IN AUGER TYPE ICE MAKING MACHINE

[75] Inventors: Yoshikazu Kito, Obu; Susumu Tatematsu, Nagoya, both of Japan

[73] Assignee: Hoshizaki Electric Company Ltd., Sakae, Japan

[21] Appl. No.: 141,379

[22] Filed: Jan. 7, 1988

[30] Foreign Application Priority Data

Jan. 8, 1987 [JP] Japan ..... 62-1293[U]

[51] Int. Cl.[4] ..... F25C 1/14

[52] U.S. Cl. ..... 62/354; 100/131; 222/108

[58] Field of Search ..... 100/131–136; 222/108, 109; 62/354

[56] References Cited

U.S. PATENT DOCUMENTS

| | | | |
|---|---|---|---|
| 1,911,687 | 5/1933 | Hafley | 100/131 X |
| 2,083,990 | 6/1937 | Fuchs | 222/108 |
| 2,796,826 | 6/1957 | Keiper | 100/136 X |
| 3,327,902 | 6/1967 | Alterwitz | 222/108 |
| 3,702,543 | 11/1972 | Lyman | 62/354 |
| 3,769,809 | 11/1973 | Robinson et al. | 62/354 X |
| 4,562,941 | 1/1986 | Sanfilippo | 222/108 |

*Primary Examiner*—William E. Tapolcai
*Attorney, Agent, or Firm*—Schwartz & Weinrieb

[57] ABSTRACT

There is provided an ice discharge section in an auger type ice making machine wherein an evaporator connected to a refrigerating system is sealingly wound along the outer periphery of a cylindrical refrigerating casing and the thin ice formed upon the inner wall surface of the refrigerating casing is scrapped off by an auger rotatably supported within the interior of the refrigerating casing so as to transfer the resulting ice flakes upwardly so that the compressed ice obtained by compressing these ice flakes by an extruding head may be discharged into an ice storage chamber via an ice discharge passage provided at the top of the refrigerating casing, characterized in that an ice transfer passage disposed within the interior of the ice storage chamber is connected to an opening of the ice discharge passage, an ice transfer passage having a drainage portion is disposed in the area immediately downstream of the opening and has an upwardly inclined surface continuing after the drainage portion, and a water collecting section is provided between the drainage portion and the upwardly inclined surface for recovering water so as to drain it to the exterior of the machine.

2 Claims, 5 Drawing Sheets

ICE DISCHARGE SECTION IN AUGER TYPE ICE MAKING MACHINE

FIELD OF THE INVENTION

This invention relates to an auger type ice making machine and more particularly to an ice discharge section of an auger type ice making machine wherein ice scraped off from the interior surface of the refrigerating casing by means of the auger is compressed by means of an extruding head so as to produce compressed ice which will be discharged into an ice storage chamber out of from an ice discharge passage provided at the top of the refrigerating casing, characterized in that the water formed when ice flakes are compressed by means of the extruding head may be effectively separated from the compressed ice so as to be discharged to the exterior of the machine so that arching, bridging, or fusing together of the compressed ice blocks, which may otherwise be formed between the compressed ice blocks stored within the ice storage chamber, may be prevented.

BACKGROUND OF THE INVENTION

Auger type ice making machines have conveniently been used in cooking establishments such as restaurants and the like and in applications for refrigerating fish for preservation purposes, wherein ice is formed in the form of a layer upon the inner wall of a cylindrical refrigerating casing, and this ice layer is scraped off from the refrigerating casing by means of the auger and the ice flakes so formed are transferred upwardly so as to be compressed into columnar ice which is cut to a predetermined size by means of a cutter so as to make compressed ice blocks. Since this invention relates to an improvement of the ice discharge section of the auger type ice making machine, for the purpose of easier understanding, the general construction of the auger type ice making machine will first be described with reference to FIG. 5.

Referring to an ice making mechanism 17 shown in FIG. 5, an evaporator 12 which communicates with a refrigerating system is sealingly wound along the outer periphery of the cylindrical refrigerating casing 10, and a refrigerant is circulated through the tubular body forming the evaporator coil 12 during operation such that the refrigerating casing 10 may be cooled in a heat exchange manner. Interiorly of the refrigerating case 10 there is rotatably provided the auger 14 which is vertically aligned with the axis of the casing in such a way that it is rotatably supported by means of bearings disposed at the top and the bottom. A cutting edge **14*a* which has an outer diameter slightly smaller than the inner diameter of the refrigerating casing 10 is spirally formed upon the auger 14 so that the thin ice formed upon the inner wall surface of the refrigerating casing 10 in the form of a layer may be scraped off and removed by means of the cutting edge 14*a* and transferred upwardly. It should be noted that the reference numeral 15 designates a motor which drives the auger 14**.

The extruding head 16, which may also serve as an upper bearing for the auger 14, is disposed at the top of the refrigerating casing 10 so as to compress the sherbet-state ice flakes, scraped off as a result of the rotation of the auger 14 and transferred upwardly thereby when they are allowed to pass through the compression passage bored through the extruding head 16 so as to form continuous columnar compressed ice. The columnar ice extruded out of the extruding head 16 is sequentially cut by means of a cutter 18 provided at the top of the extruding head 16 so as to be formed into ice blocks of a predetermined size.

At the top of the ice making mechanism 17 where the extruding head 16 and the cutter 18 are disposed, a duct-shaped ice discharge passage 28 is provided so as to extend horizontally into an ice storage chamber 26 so that it may discharge the compressed ice blocks of a predetermined size made within the ice making mechanism 17 into the ice storage chamber 26 via an ice discharge port 20. For example, one end 22 of the ice discharge port 20 having a flange **20*a* is inserted through a through hole 30*a* bored through a wall 30 of the ice storage chamber 26, whereas the other end 24 which includes an ice block discharge ramp 20*c*, is disposed within the interior of the ice storage chamber 26. The ice discharge port 20 is positioned by making the flange 20*a* abut against the wall 30, and the flange 20*a* is fixed to the wall 30 by means of a plurality of screws 32. The end portion 28*a* of the ice discharge passage 28 is inserted into the open duct 20*b* of the ice discharge port 20 whereby the ice discharge passage 28 may communicate with the ice storage chamber 26 via the ice discharge port 20**.

Incidentally, an agitator which agitates the stored ice and an ice conveying mechanism which carries the compressed ice to the exterior of the machine (neither of which is shown) are disposed within the ice storage chamber 26 as necessary.

In general, in the auger type ice making machine the ice flakes scraped from the inner wall surface of the refrigerating casing 10 by means of the cutting edge **14*a* of the auger 14 are forcibly compressed when they pass through the compression passage of the extruding head 16 in their sherbet-state, and during this process water is inevitably formed. This water is discharged into the ice storage chamber 26 in the state where it clings to the compressed ice. Furthermore, part of the water clinging to the compressed ice will collect upon the bottom surface of the ice discharge passage 28 or ice discharge port 20 so as to stay there and is transferred together with the ice blocks when the compressed ice moves through the ice discharge passage 28 and drops from the opening 20*b* of the ice discharge port 20 into the ice storage chamber 26**.

Consequently, if the compressed ice is stored within the ice storage chamber 26 for a long period of time, the water clinging to the ice or the water which has dripped from the ice discharge port 20 will again freeze, resulting in so-called arching or bridging, that is, adjacent ice blocks are combined or fused together with one another. Still further, if the bonding force of the fused ice blocks which has occurred within the ice storage chamber 26 is strong, excessive load can be applied to the agitator which agitates the ice or the ice conveying means which carries the ice out of the ice storage chamber 26 or the like so as to shorten the life of the components, leading to breakdown of the machine. Additional problems also occur when the ice is to be discharged from the ice storage chamber 26 in that the compressed ice can neither be discharged out of the ice storage chamber 26 due to the above-mentioned arching, nor can compressed ice of uniform size be reliably supplied in constant amounts.

OBJECT OF THE INVENTION

In view of the foregoing drawbacks inherent in a conventional auger type ice making machine, this invention was proposed to resolve such problems. An object of the invention is therefore to provide a novel means which allows the compressed ice made within the ice making mechanism and the water clinging thereto to be effectively separated prior to being discharged into the ice storage chamber as well as allows the collected water to be drained out to the exterior of the machine, so that the arching may be effectively prevented from occurring within the chamber.

SUMMARY OF THE INVENTION

According to the invention, there is provided the ice discharge section within the auger type ice making machine wherein the evaporator 12 connected to the refrigerating system is sealingly wound along the outer periphery of the cylindrical refrigerating casing 10 and the thin ice formed upon the inner wall surface of the refrigerating casing 10 is scraped off and removed by means of the auger 14 rotatably supported within the interior of this refrigerating casing 10 so as to transfer the resulting ice flakes upwardly so that the compressed ice obtained by compressing these ice flakes by means of the extruding head 16 may be discharged into the ice storage chamber 26 via the ice discharge passage 28 provided at the top of the refrigerating casing 10, characterized in that an ice transfer passage 36 disposed within the interior of the ice storage chamber 26 is connected to the opening 28*a* of the ice discharge passage 28, wherein the ice transfer passage 36 has a drainage portion 40 disposed immediately downstream of the opening 28*a* and an upwardly inclined surface 46 continuing downstream of the drainage portion 40, and wherein further, a water collecting section 50 is provided between the drainage portion 40 and the upwardly inclined surface 46 for recovering the water so as to drain it to the exterior of the machine.

Since the ice discharge section of the ice making machine according to the invention is constructed in such a way that the compressed ice passing through the extruding head and the water clinging thereto are effectively separated prior to being discharged into the ice storage chamber, the arching, that is, refreezing of the water within the ice storage chamber so as to bridge or fuse adjacent compressed ice blocks together, can be effectively prevented from occurring. Consequently, excessive load cannot be applied to the agitator or ice discharge means disposed within the ice storage chamber resulting in prolonged life of the machine. Moreover, since the arching of or strong binding force does not occur, even if the ice blocks are stored within the chamber for a long period of time, the formation, storage, and discharge of the compressed ice can be effectively carried out in stable amounts.

BRIEF DESCRIPTION OF THE DRAWINGS

The drawings illustrate a preferred embodiment of the ice discharge section of the auger type ice making machine, wherein like reference characters designate like or corresponding parts throughout the several views, and wherein further.

PREFERRED EMBODIMENT OF THE INVENTION

Figure 1:
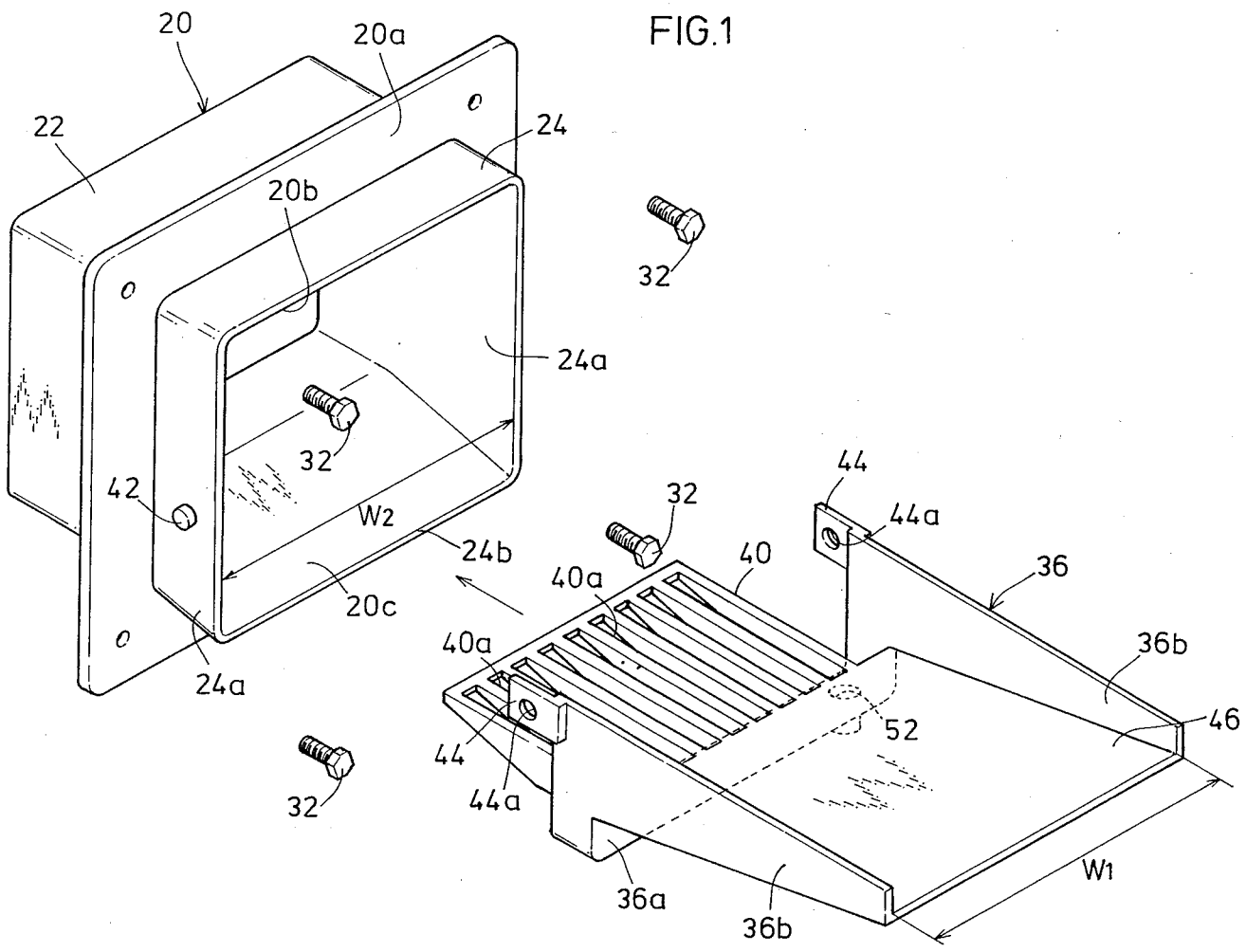
FIG. 1 is an exploded perspective view of the ice discharge section according to the preferred embodiment of the invention.
Figure 2:
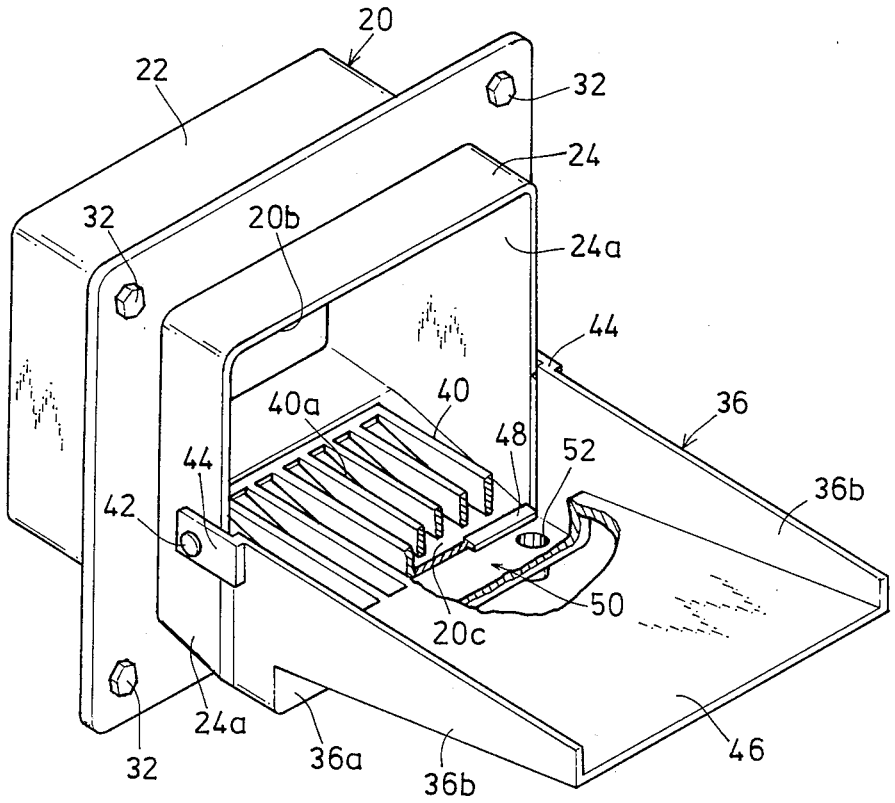
FIG. 2 is a partially cutaway perspective view illustrating the assembled state of the ice discharge section shown in FIG. 1.
Figure 3:
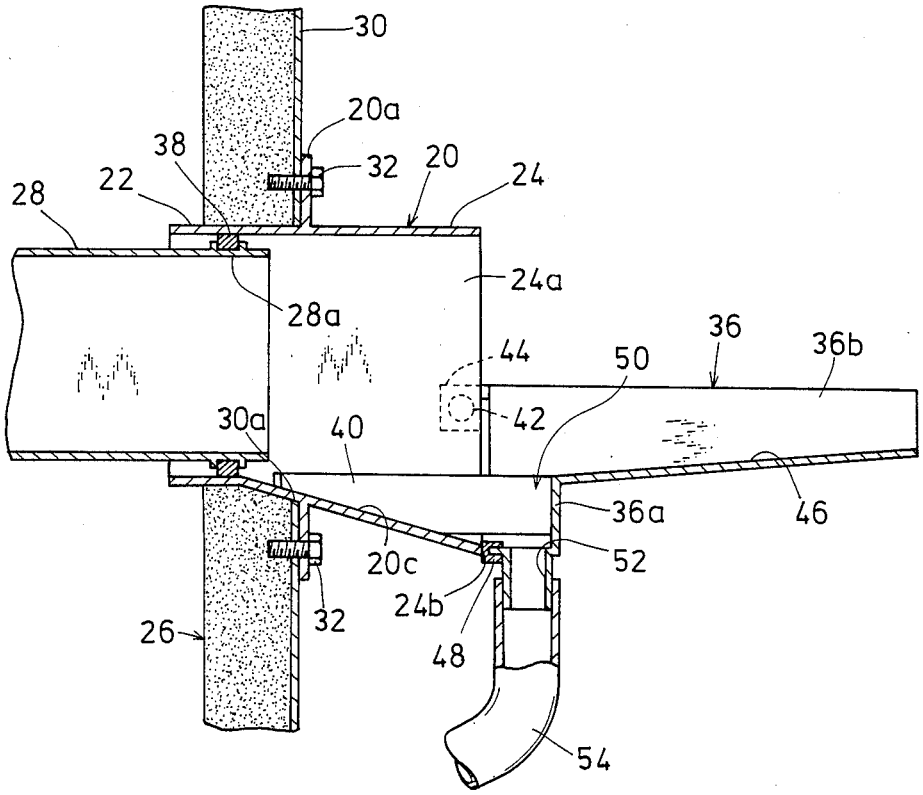
FIG. 3 is a longitudinal cross-sectional view illustrating the state in which the ice discharge section shown in FIG. 1 is attached to the ice discharge passage of the auger type ice making machine.

Referring now to FIGS. 1–4, the ice discharge section of the auger type ice making machine according to the invention is described hereinafter by way of a preferred embodiment with reference to the appended drawings. It should be appreciated that the detailed description of the mechanism itself for making ice is omitted since it is substantially the same as in the prior art auger type ice making machine. As shown in FIG. 3, the ice discharge section of the embodiment comprises the ice transfer passage 36 disposed within the interior of the ice storage chamber 26 which communicates with the opening 28*a* of the ice discharge passage 28, and the ice transfer passage 36 has a drainage portion 40 and an inclined surface 46 inclined upwardly from the drainage portion 40. Moreover, between the drainage portion 40 and the upwardly inclined surface 46 there is provided a water collecting section 50 which recovers the water, formed when the ice flakes are compressed, to be discharged to the exterior of the machine.

This ice transfer passage 36 is an ice guiding member through which the compressed ice is guided and carried from the ice discharge passage 28 of the ice making machine toward the ice storage chamber 26, and is removably attached to the ice discharge port 20 which communicates with the ice discharge passage 28. Namely, the ice discharge port 20 comprises a rectangular cylindrical hollow frame body upon the outside of which a flange 20*a* is integrally formed. An extension 22 disposed to the left with respect to the flange 20*a* is inserted into a rectangular through hole 30*a* bored through a wall 30 which defines the inner wall of the ice storage chamber 26, and is fastened by means of a plurality of screws 32 with the flange 20*a* abutting against the wall 30 so that the ice discharge port 20 may be fixed to the inner wall of the ice storage chamber. At this time, the extension 22 of the ice discharge port 20 surrounds the open end portion 28*a* of the ice discharge port 28 about the exterior periphery thereof with a water-tight connection being achieved by means of a packing 38 interposed between the inner surface of the extension 22 and the exterior surface of the open end portion 28*a*.

The bottom surface 20*c* of the ice discharge port 20 is inclined downwardly toward the bottom of the ice storage chamber 26 as shown in FIG. 3, and the drainage portion 40 of the ice guiding member 36, which will be described later, is adapted to be sealingly engageable with the inclined bottom surface 20*c*. Furthermore, at required positions on the exterior surfaces of both side plates 24*a* of the extension 24 located on the right side of the flange 20*a* there is provided corresponding cylindrical protrusions 42, respectively, for connecting the ice transfer passage 36 (ice guiding member), which will be described later, to the ice discharge port 20 as a result of the cylindrical protrusions being inserted into the holes 44a of the ice transfer passage 36.

As shown in FIGS. 2 and 3, the ice transfer passage 36 is removably attached to the extension 24 of the ice discharge port 20 so as to project into the ice storage chamber 26. In other words, the ice transfer passage 36, as described above, comprises the drainage portion 40 and the upwardly inclined surface 46, the drainage portion 40 of the embodiment shown comprising a drainboard in which a plurality of slit-shaped clearances 40a are provided so as to be adjacent to one another with required intervals therebetween. As can be seen from FIG. 3, this drainage portion 40 is provided such that it may be positioned immediately forward or downstream of the open end portion 28a of the ice discharge passage 28 when the passage 36 is attached to the port 20. Furthermore, in the ice transfer passage 36 there is formed the surface (guiding surface) 46 which inclines upwardly in a continuous manner with respect to the upstanding portion 36a which rises with a required level with respect to the drainage portion 40.

At both sides of the inclined surface 46 there is provided vertically upstanding side plates 36b having a required height while arms 44 are integrally formed with side plates 36b so as to be disposed toward the drainage portion 40. A through hole 44a is formed in these arms 44. By allowing these through holes 44a to be in engagement with the corresponding protrusions 42 provided upon the extensions 24 of the ice discharge port 20, the ice transfer passage 36 may be removably attached to the ice discharge port 20. It should be noted that the width $W_1$ between the side plates 36b of the inclined surface 46 is set to be substantially the same as the inner width $W_2$ of the extension 24 of the ice discharge port 20.

Consequently, when the ice transfer passage 36 is attached to the ice discharge port 20, the upstanding portion 36a of the ice transfer passage 36 may be watertightly attached through means of packing 48 to the open edge 24b of the extension 24 of the ice discharge port 20, whereby the water collecting section 50 is formed within the area where the drainage portion 40 terminates and the upwardly inclined surface 46 begins. At this water collecting section 50 there is provided a drainage port 52 and the water which is recovered within the water collecting section 50 is designed to be discharged to the exterior of the machine by means of a drainage pipe 54 connected to the drainage port 52.

Figure 4:
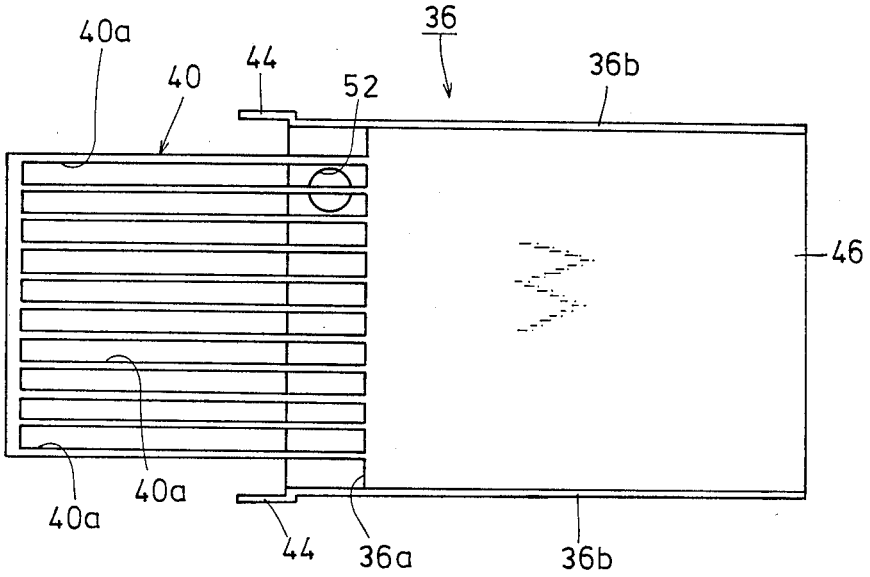
FIG. 4 is a plan view of the ice transfer passage.
Figure 5:
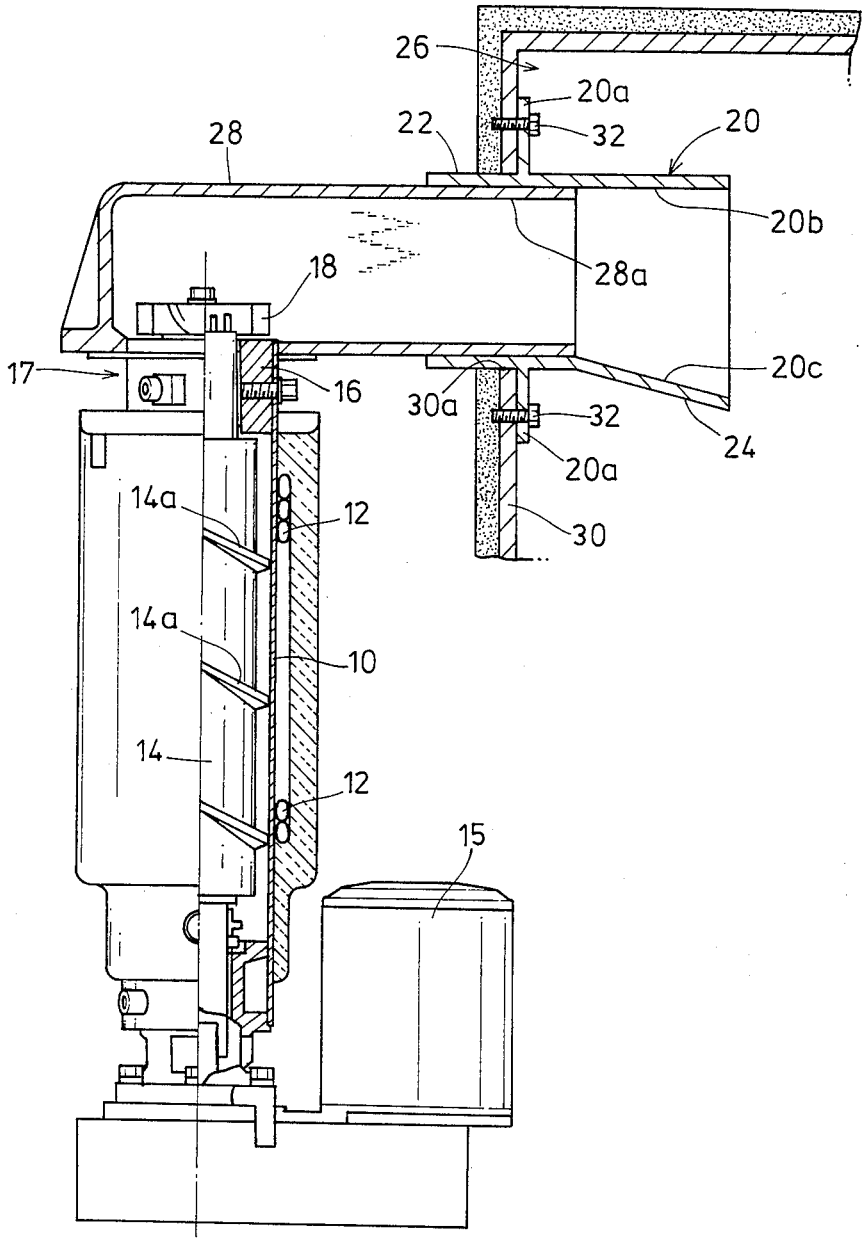
FIG.5 PRIOR ART
FIG. 5 is a side elevational view illustrating partly in cross section the ice making mechanism of the prior art auger type ice making machine.

As disclosed in FIG. 4, the drainage portion 40 is set to have a width smaller than that of the inclined surface 46, while its bottom surface is set at an angle of inclination such that it may be closely attached to the inclined bottom surface 20c of the ice discharge port 20 when the ice transfer passage 36 is attached to the ice discharge port 20 (see FIG. 3). In addition, the slit-shaped clearances 40a of the drainage portion 40 are formed parallel to the travelling direction of the compressed ice so that the ice may be smoothly transferred toward the ice storage chamber 26. Incidentally, instead of forming the above-mentioned slit-shaped clearances 40a within the drainage portion 40, a multiplicity of through holes or a mesh portion may be provided so long as it is suitable for the drainage purpose as an alternative to the slit clearances 40a.

Next, the function of the ice discharge section of the thus constructed auger type ice making machine will be described. When the operation of the auger type ice making machine is started, the ice formed in the form of a layer upon the inner wall of the refrigerating casing 10 is scraped off by means of the cutting edge 14a of the auger 14 and is transferred upwardly. It is forcibly compressed so as to form a column of compressed ice when it passes through the passage bored through the extruding head 16. The columnar ice which has continuously been extruded out of the extruding head 16 is cut by means of the cutter 18 into compressed ice blocks having a predetermined size. When the ice is compressed and cut respectively by means of the extruding head 16 and the cutter 18, as described above, water will inevitably be formed, which water clings by surface tension to the surface of the ice blocks obtained or to the apparatus surfaces between the blocks of ice.

The ice continuously compressed and formed by means of the extruding head 16 is moved through the ice discharge passage 28 toward the ice storage chamber 26, with water clinging to the surface thereof. While the compressed ice moves along the ice discharge passage 28, the water clinging to the compressed ice will gradually drop so as to be collected upon the bottom surface of the ice discharge passage 28. The water which has been collected within the ice discharge passage 28 is conducted to the ice discharge passage 20 together with the compressed ice which is sequentially extruded out of the extruding head 16. As described above, since the drainage portion 40 within the ice transfer passage 36 is disposed at the inclined bottom surface 20c of the ice discharge port 20, the conducted water will drop through the slit clearances 40a of the drainage portion 40 so as to flow downwardly along the inclined bottom surface 20c of the ice discharge port 20.

Moreover, water will be separated from the compressed ice being transferred through the drainage portion 40, and will drip therefrom by means of its own weight downwardly through the slit clearances 40a. The water dripping through the slit clearances 40a is all recovered within the water collecting section 50 formed within the vicinity of the upstanding section 36a and is drained to the exterior of the machine out of the drainage port 52 provided within the water collecting section 50 via the drainage pipe 54.

As described above, the compressed ice from which water has been separated over the drainage portion 40 will then pass over the upwardly inclined surface 46 within the ice transfer passage 36 and finally be discharged into the ice storage chamber 26. During this process, the water which failed to be separated from the compressed ice over the drainage portion 40 will almost all be separated therefrom during the process where the ice is in turn carried along the inclined surface 46, flowing down along the inclined surface 46 so as to be recovered within the water collecting section 50. Namely, the compressed ice discharged from the ice transfer passage 36 into the ice storage chamber 26 is substantially free from water. As a result, not only does the arching phenomenon hardly ever occur wherein the water again freezes within the ice storage chamber 26 so as to fuse the compressed ice blcks to one another, but also ice blocks can be easily carried or removed to the outside of the machine whenever it is desired to take them out from the machine.

Obviously, many modifications and variations of the present invention are possible in light of the above teachings. It is therefore to be understood that within the scope of the appended claims, the present invention may be practiced otherwise than as specifically described herein.

What is claimed is:

1. An ice discharge section in an auger type ice making machine wherein an evaporator connected to a refrigerating system is sealingly wound along an outer peripheral surface of a cylindrical refrigerating casing and thin ice formed upon an inner wall surface of said refrigerating casing is scraped off by means of an auger rotatably supported interiorly of said refrigerating casing so as to transfer the resulting ice flakes upwardly so that compressed ice obtained by compressing said ice flakes by means of an extruding head may be discharged into an ice storage chamber by means of an ice discharge passage provided at the top of said refrigerating casing, characterized in that:

an ice transfer passage disposed within the interior of said ice storage chamber is connected to an open end of said ice discharge passage;

said ice transfer passage comprises a drainage portion within the area disposed immediately downstream of said open end of said ice discharge passage, and an upwardly inclined surface disposed immediately downstream of said drainage portion; and a water collecting section provided between said drainage portion and said upwardly inclined surface for recovering water so as to drain said water from said ice transfer passage to the exterior of said machine.

2. The ice discharge section in an auger type ice making machine according to claim 1 characterized in that:

said ice transfer passage is comprised of an ice guiding member which is removably attached to a rectangular cylindrical ice discharge port surrounding said ice discharge passage and which communicates with said ice storage chamber;

said ice guiding member has a drainboard-like drainage portion which is sealingly engageable with a bottom surface of said ice discharge port, which is inclined downwardly, when attached to said ice discharge port, and an inclined surface which inclines upwardly at a downstream location relative to an upstanding portion of said drainage portion with a required degree of incline with respect to said drainage portion; and said water collecting section is formed within the vicinity of said upstanding portion within the area which communicates said drainboard-like drainage portion with said upwardly inclined surface, a drain port being formed within said water collecting section.

* * * * *